United States Patent [19]

Hoeberechts

[11] 4,096,407

[45] Jun. 20, 1978

[54] TELEVISION CAMERA TUBE COMPRISING MOSAIC OF CONDUCTIVE REGIONS SEPARATED BY INSULATOR FROM SEMICONDUCTOR PLATE

[75] Inventor: Arthur Marie Eugene Hoeberechts, Eindhoven, Netherlands

[73] Assignee: U.S. Philips Corporation, New York, N.Y.

[21] Appl. No.: 771,698

[22] Filed: Feb. 24, 1977

[30] Foreign Application Priority Data

Feb. 27, 1976 Netherlands ..... 7602013

[51] Int. Cl.[2] ..... H01J 29/45; H01J 31/38

[52] U.S. Cl. ..... 313/367; 357/31

[58] Field of Search ..... 313/367, 392; 357/31

[56] References Cited

U.S. PATENT DOCUMENTS 3,474,285 10/1969 Goetzberger ..... 313/392 X 3,983,574 9/1976 Statz et al. ..... 313/367

*Primary Examiner*—Robert Segal

*Attorney, Agent, or Firm*—Frank R. Trifari; Carl P. Steinhauser

[57] ABSTRACT

A television camera tube having a semiconductor target which on the side to be scanned by an electron beam comprises a mosaic of electrically conductive regions each determining a picture element and separated from the semiconductor plate by an electrically insulating layer, and a resistive layer extending over the mosaic and the insulating layer which contacts the semiconductor surface via an aperture in the insulating layer present in each picture element and has a RC time between the scanning time of a picture element and the scanning time of the whole target.

7 Claims, 9 Drawing Figures

Figure 1:
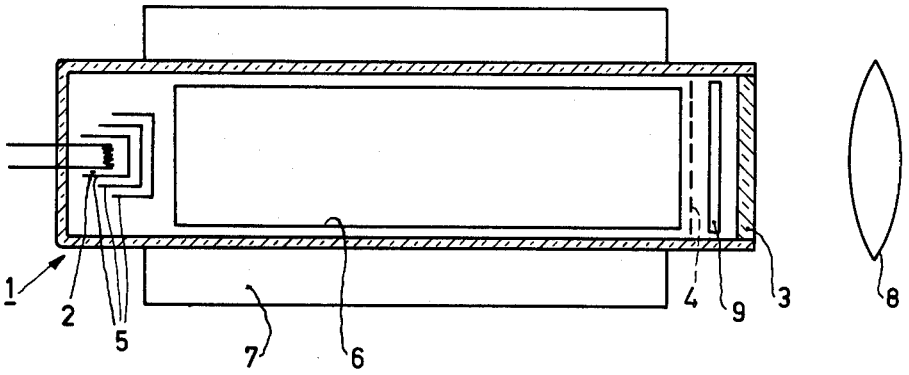

TELEVISION CAMERA TUBE COMPRISING MOSAIC OF CONDUCTIVE REGIONS SEPARATED BY INSULATOR FROM SEMICONDUCTOR PLATE

The invention relates to a camera tube having an electron source and a radiation-sensitive target to be scanned by an electron beam emanating from said source, the target being formed by a semiconductor plate which on the side to be scanned by the electron beam comprises a mosaic of electrically conductive regions each determining a picture element and separated from the semiconductor plate by an electrically insulating layer, and a resistive layer extending across the mosaic and the insulating layer.

A camera tube of the kind mentioned in the preamble is known from U.S. Pat. No. Spec. 3,474,285.

In the last-mentioned camera tube there is present between the insulating layer and the resistive layer, besides the conductive regions, a conductive grid surrounding each conductive region individually. For example, a p-type semiconductor plate is used and a positive voltage is given to the conductive regions by means of the conductive grid via the resistive layer, so that a depletion region is formed below the conductive regions in the semiconductor plate.

When under the influence of incident light charge carriers are generated in the semiconductor plate, electrons will move towards the depletion region and invert same.

The scanning electron beam will inject the electrons collected in the inversion region into the semiconductor plate and cause an outgoing signal which is decisive of the received quantity of light. After this, the conductive grid must bring the conductive regions again at positive potential.

In practice it has been found that it is not simple to satisfy the requirements as regards a ready operation of such a camera tube. Inter alia, the camera tube described required an adapted electronic control which differs from and is more complicated than the normally used control. For scanning the target a comparatively high beam current is necessary because this is easily deflected in practice towards the conductive grid which as a rule has a higher positive voltage than the conductive regions. A higher beam current is often associated with a short life of the electron source, while the beam current is used effectively little.

In addition, the conductive grid has a comparatively large area and hence an unfavourable influence on the beam acceptance of the picture element.

One of the objects of the invention is to avoid this problem at least to a considerable extent. It is based on the discovery that a camera tube operates more simply if during the scanning time the charge of the conductive region can be compensated for by the charge collected in the inverted region.

According to the invention, a camera tube of the afore described kind is provided with a resistive layer which makes a rectifying contact with the semiconductor surface via an aperture in the insulating layer present in each picture element so as to obtain exchange of charge between the conductive regions and the respective parts of the target present below the regions, the RC time of the capacitor formed by a conductive region, the insulating layer and the underlying part of the semiconductor surface, and the part of the resistive layer present between a conductive region and the semiconductor surface being shorter than the scanning time of the whole side to be scanned.

The starting material in such a camera tube may be an n-type semiconductor plate. A depletion region is formed below the conductive regions in the semiconductor plate. Holes generated by radiation move towards the depletion region and invert same.

The holes inject into the resistive layer via the apertures in the insulating layer and at least partly neutralize the charge present in the conductive regions.

The resistive layer has such a shape and composition that in one respect shortcircuit phenomena, expressed in degradation of the picture definition, between conductive regions and target are avoided and otherwise the desired exchange of charge takes place within the scanning time of the target so as to prevent undesired picture lag.

The charging by the electron beam returning to the conductive region depends on the discharge having taken place during the absence of the electron beam and gives rise to an external signal which is proportional to the radiation intensity integrated over the scanning time.

The camera tube according to the invention does not require a particular electronic circuit. The electron beam required for scanning also has a normal strength.

The camera tube according to the invention is essentially composed of a mosaic of MOS capacitances which are each provided with a defined leakage. This leakage can be realized in several manners. Preferably, the resistive layer contacts the semiconductive surface via apertures in the electrically conductive regions and in the insulating layer.

This construction is very suitable if a short leakage path is desired. If this is not the case, another simple construction of the camera tube according to the invention is that in which juxtaposed conductive regions have common apertures in the insulating layer via which apertures the resistive layer contacts the semiconductor surface.

In the case of conductive regions of a square shape, the common aperture might be provided, for example, across the corners of adjacent conductive regions.

The manufacture can be particularly simple if the common apertures preferably form a pattern of closed channels which bounds each picture element. In the manufacture of this embodiment both the mosaic of conductive regions and the pattern of channels may be formed for example, by means of one masking step.

When a pattern of closed channels is used, there is preferably present at the area of the pattern of closed channels in the semiconductor target, a zone of the same conductivity type as but having a higher conductivity than that of the material of the semiconductor target surrounding the zone, said zone extending along the whole surface of the channels and not covering edge portions thereof adjoining the insulating layer.

The zone serves as a channel stopper between the individual MOS capacitances and prevents the so-called blooming effect in which charge carriers generated in a given picture element flow away to an adjacent picture element. The desired exchange of charge between the conductive regions and the underlying parts of the target then takes place via the edge portions.

This exchange of charge can specifically be restricted to the edge portions if the surface of the zone is covered with an insulating layer.

The semiconductor body preferably consists of silicon and the resistive layer of gallium selenide and/or germanium sulphide.

The junctions between silicon and layers consisting of said materials show blocking properties for electrons so that low leakage currents are obtained.

In general, the other materials for the resistive layer may alternatively be used, for example, those which are used in silicon multidiode vidicons.

Figure 9:
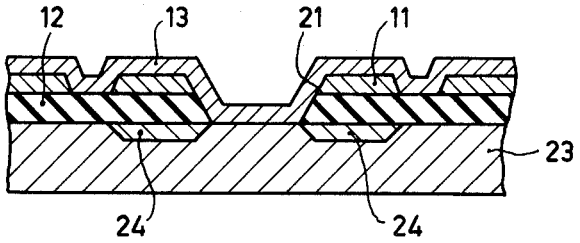
Figure 3:
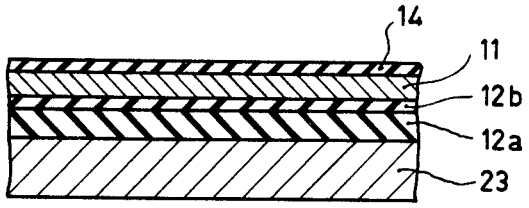
Figure 7:
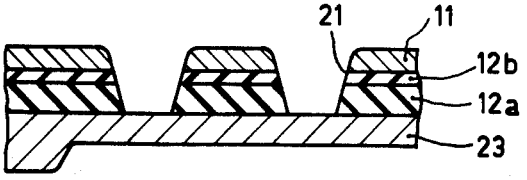
Figure 8:
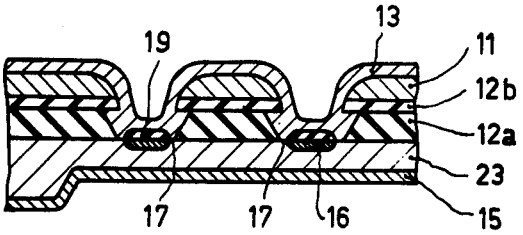

The invention will be described in greater detail with reference to the accompanying drawing and a few examples. In the drawing FIG. 1 is a diagrammatic sectional view of an embodiment of a camera tube according to the invention, FIG. 2 is a diagrammatic sectional view of a part of a target of an embodiment of a camera tube according to the invention, FIGS. 3 to 6 are diagrammatic sectional views of the target shown in FIG. 2 in a number of stages of manufacture, FIGS. 7 and 8 are diagrammatic sectional views of a modified embodiment of the target shown in FIG. 2 in a number of stages of manufacture, FIG. 9 is a diagrammatic sectional view of a target of another embodiment of a camera tube according to the invention.

Figure 2:
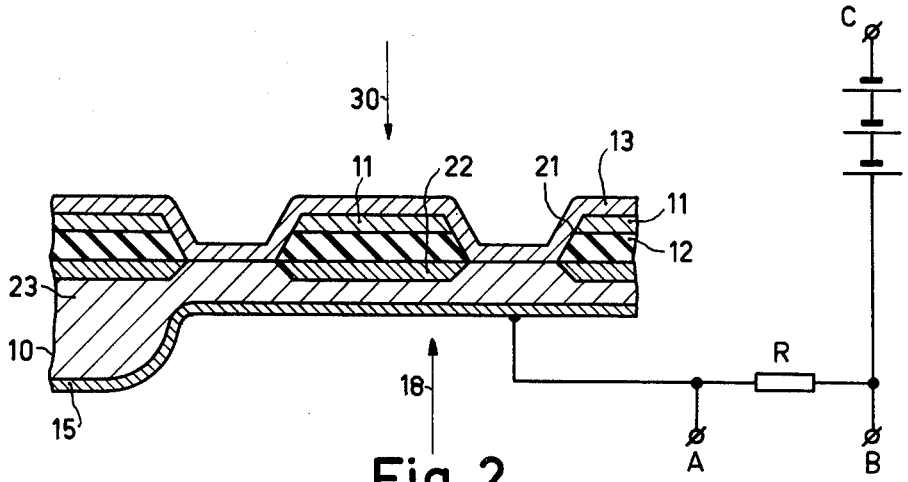

The camera tube 1, for example a television camera tube, shown in FIG. 1 has an electron source or cathode 2 and a radiation-sensitive target 9 to be scanned by an electron beam emanating from said source 2 (see also FIG. 2 and followings Figures). The target 9 is formed by a semiconductor plate 10 which on the side to be scanned by the electron beam 30 comprises a mosaic of electrically conductive regions 11 each determining a picture element. The regions 11 are separated from the semiconductor plate 10 by an insulating layer 12. The semiconductor plate 10 furthermore comprises a resistive layer 13 extending over the mosaic and the insulating layer 12.

According to the invention, the resistive layer 13 makes a rectifying contact with the semiconductor surface via an aperture 21 present in each picture element so as to obtain exchange of charge between the conductive regions 11 and the respective parts 22 of the semiconductor plate 10 present below the regions.

The RC time of the capacitor formed by a region 11, the insulating layer 12 and the underlying part of the semiconductor surface, and the part of the resistive layer 13 present between a conductive region 11 and the semiconductor surface is shorter than the scanning time of the whole side to be scanned.

The camera tube comprises in the usual manner electrodes 5 for accelerating electrons and for focusing the electron beam. Furthermore, usual means are present to deflect the electron beam so that the target 9 can be scanned.

These means consist, for example, of a system of coils 7. The electrode 6 serves to screen the tube wall from the electron beam. A scene to be recorded is projected on the target 9 by means of the lens 8, the wall 3 of the tube being radiation-permeable.

Furthermore, a collector grid 4 is present in the usual manner. By means of the grid which, for example, may be an annular electrode, secondary electrons originating from the target 9 may be dissipated.

During operation, the substrate 23 which consists of n-type silicon is biased positively relative to the cathode 2. In FIG. 2, the cathode 2 is to be connected to the point C. When the electron beam 30 passes through a region 11, this region is charged to substantially the cathode potential in which in the first instance a part 22 which is depleted as regards charge carriers is formed.

Dependent on the intensity of the radiation 18 which impinges upon the target in the vicinity of the relevant region 11, the corresponding part 22 is inverted as regards conductivity type and the region 11 is fully or partly discharged.

When the electron beam again passes through the region 11, charge is added again until the region has substantially assumed the cathode potential. This charging results in a current across the resistor R. This current is a measure of the intensity of the radiation 18 which has discharged the region 11 fully or partly in one scanning cycle. Output signals are derived from the terminals A and B via the resistor R. In the target shown in FIG. 2, adjacent conductive regions 11 have common apertures 21 in the insulating layer 12, via which apertures the resistive layer 13 contacts the semiconductor surface.

The manufacture can be particularly simple when these common apertures form a pattern of closed channels which bounds each picture element.

The target 9 can be manufactured as follows. Starting material is an n-type silicon substrate (FIG. 3) on which a 0.12 $\mu$m thick silicon oxide layer **12*a*** is formed in the usual manner by oxidation.

A 0.04 $\mu$m thick silicon nitride layer **12*b* is deposited on the layer 12*a*. The layers 12*a* and 12*b* together constitute the electrically insulating layer 12**.

A 0.3 $\mu$m thick layer of polysilicon 11 is formed on the layer 12, which layer 11 is provided with a 0.1 $\mu$m thick silicon oxide layer 14 by oxidation.

Figure 4:
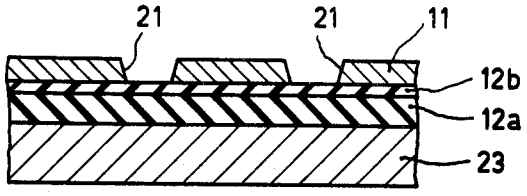

1 to 2 $\mu$m wide apertures 21 are then formed in the layers 14 and 11 by means of a usual photo-etching method, which apertures form a pattern of closed channels, and the layer 14 is removed (see FIG. 4).

Figure 5:
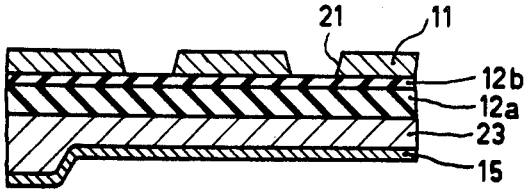

Phosphorus is then deposited and diffused so that the regions 11 become electrically conductive and an $n^+$ region 15 is formed on the radiation side of the silicon plate (FIG. 5).

Figure 6:
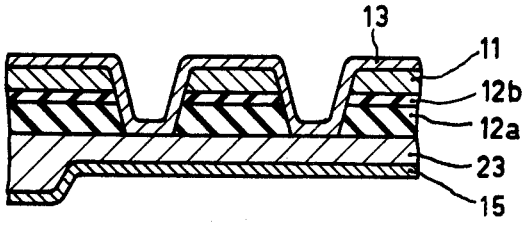

At the area of the apertures 21, apertures are then also formed in the layers **12*b* and 12*a* and a resistive layer 13 is provided in the usual manner (FIG. 6**).

The apertures 21 in the layers **12*b* and 12*a* may alternatively be formed prior to the phosphorus deposition and diffusion (FIG. 7**).

In addition to the layer 15, a zone 16 of the n-conductivity type but having a higher conductibility than that of the material of the silicon type surrounding the zone is then formed by deposition and diffusion of phosphorus at the area of the pattern of closed channels in the silicon target.

With the apertures formed in the layers **12*a* and 12*b* it is ensured that said layers are slightly etched under the layer 11 so that the zone 16 extends along the whole channel surface and does not cover edge portions 17 thereof adjoining the insulating layer 12 (FIG. 8**).

The zone 16 may then be provided with an oxide layer 19 in a usual manner, for example, anodically.

The resistive layer 13 to be provided consists of gallium selenide and/or germanium sulphide.

A usual value for the scanning time of the target is approximatly 3 to $4\times10^{-2}$ sec. The scanning time per picture element is approximately $10^{-7}$ sec.

The electrically conductive regions have dimensions of 3 μm × 3 μm to 25 μm × 25 μm, for example 10 μm × 10 μm.

The resistive layer 13 has a resistance per square of $10^{11} - 10^{14}$ Ω/□, for example $10^{12}$ Ω/□ and is, for example, 1 μm thick.

Edge portions between the insulating layer and the zone are for example, 1 μm wide.

In these circumstances the RC time of the capacitor and the part of the resistive layer present between a conductive region and the semiconductor surface is approximately $10^{-4}$ sec.

In another embodiment of the camera tube according to the invention the resistive layer 13 contacts the semiconductor surface via apertures 21 in the electrically conductive regions 11 and in the insulating layer 12 (FIG. 9). In this case the depletion region 24 determining the picture element is annular.

It will be obvious that the invention is not restricted to the example described but that many variations are possible to those skilled in the art without departing from the scope of this invention, for example, as regards the choice of the resistive layer.

What is claimed is:

1. A camera tube having an electron source and a radiation-sensitive target to be scanned by an electron beam emanating from said source, said target comprising a semiconductor plate which on the side to be scanned by the electron beam comprises a mosaic of electrically conductive regions each determining a picture element and separated from the semiconductor plate by an electrically insulating layer, and a resistive layer extending across the mosaic and the insulating layer, said resistive layer making a rectifying contact with the semiconductor surface via an aperture in the insulating layer present in each picture element so as to obtain exchange of charge between the conductive regions and the respective parts of the targer present below the regions, the RC time of the capacitor formed by a conductive region, the insulating layer and the underlying part of the semiconductor surface, and the part of the resistive layer situated between a conductive region and the semiconductor surface being shorter than the scanning time of the whole side to be scanned.

2. A camera tube as claimed in claim 1, wherein the resistive layer contacts the semiconductor surface via apertures in the electrically conductive regions and in the insulating layer.

3. A camera tube as claimed in claim 1, wherein juxtaposed conductive regions have common apertures in the insulating layer via which apertures the resistive layer contacts the semiconductor surface.

4. A camera tube as claimed in claim 3, wherein the common aperture form a pattern of closed channels which bounds each picture element.

5. A camera tube as claimed in claim 4, wherein at the area of the pattern of closed channels there is present in the semiconductor target a zone of the same conductivity type as but having a higher conductivity than that of the material of the semiconductor target surrounding the zone, said zone extending along the whole channel surface and not covering edge portions thereof adjoining the insulating layer.

6. A camera tube as claimed in claim 5, wherein the surface of the zone is covered with an insulating layer.

7. A camera tube as claimed in claim 1 wherein the semiconductor body consists of silicon and the resistive layer consists of gallium selenide or gallium sulphide.

* * * * *